US006523931B1

(12) United States Patent
Cipolla et al.

(10) Patent No.: US 6,523,931 B1
(45) Date of Patent: Feb. 25, 2003

(54) METHOD AND APPARATUS FOR PRIMING A PRINTHEAD

(75) Inventors: David Cipolla, Macedon, NY (US); Charles T. Facchini, II, Webster, NY (US); Steven J. Dietl, Ontario, NY (US); Stephen A. Smith, Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/941,244

(22) Filed: Aug. 29, 2001

(51) Int. Cl.[7] ..... B41J 2/165
(52) U.S. Cl. ..... 347/30; 347/29
(58) Field of Search ..... 347/22, 29–33, 347/36

(56) References Cited

U.S. PATENT DOCUMENTS

| | | | | |
|---|---|---|---|---|
| 4,638,337 | A | 1/1987 | Torpey et al. | 346/140 R |
| 4,849,774 | A | 7/1989 | Endo et al. | 346/140 R |
| 5,121,130 | A | 6/1992 | Hempel et al. | 346/1.1 |
| 5,250,962 | A | 10/1993 | Fisher et al. | 346/140 R |
| 5,257,044 | A | 10/1993 | Carlotta et al. | 346/140 R |
| 5,404,158 | A | 4/1995 | Carlotta et al. | 347/32 |
| 5,412,411 | A | 5/1995 | Anderson | 347/28 |
| 5,424,768 | A | 6/1995 | Dudek et al. | 347/29 |
| 5,432,538 | A | 7/1995 | Carlotta | 347/30 |
| 5,555,461 | A | 9/1996 | Ackerman | 347/33 |
| 5,757,398 | A | 5/1998 | Anderson | 347/32 |
| 6,070,961 | A | 6/2000 | Premnath et al. | 347/30 |
| 6,174,052 | B1 | 1/2001 | Eremity et al. | 347/74 |
| 6,190,007 | B1 | 2/2001 | Taylor et al. | 347/84 |
| 6,196,671 | B1 | 3/2001 | Breemes et al. | 347/86 |
| 6,364,449 | B1 * | 4/2002 | Takahashi et al. | 347/30 |

* cited by examiner

*Primary Examiner*—Raquel Yvette Gordon
*Assistant Examiner*—An H. Do
(74) *Attorney, Agent, or Firm*—Joseph M. Young

(57) ABSTRACT

A method and apparatus for priming a printhead. The method includes the steps of bringing a vacuum pump up to a predetermined speed and sealingly engaging a printhead with a capping mechanism after the pump reaches the predetermined speed. The pump is connected to the capping mechanism through a tube with a suitable volume. After a period of time long enough to prime the printhead, the capping mechanism is disengaged from the printhead.

20 Claims, 3 Drawing Sheets

METHOD AND APPARATUS FOR PRIMING A PRINTHEAD

FIELD OF THE INVENTION

The present invention relates generally to printers, such as ink jet printers, and, more particularly, to a priming system for priming a printhead.

BACKGROUND OF THE INVENTION

The present invention relates generally to printers and, more particularly, to a priming system for priming a printhead, with the advantage, for example, that the system is faster than prior art systems.

A prior art ink jet printer of the so-called "drop-on-demand" type has at least one printhead from which droplets of ink are directed towards a recording medium. Within the printhead, the ink can be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, that are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink, which forms a droplet moving in a direction away from the channel, and towards the recording medium. The channel is then refilled by capillary action, which in turn draws ink from a supply container. Operation of a thermal ink jet printer is described in, for example U.S. Pat. No. 4,849,774, the disclosure of which is incorporated by reference in it entirety.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It is useful and effective to prime a printhead before initial use to ensure that the printhead channels are completely filled with ink and contain no contaminants or air bubbles. Current priming operations involve either forcing or drawing ink through the printhead and out the printhead nozzles, while a cap sealingly encloses the nozzles. Hoses or conduits are provided to remove the ink removed from the printhead during the priming operation. The most widely used priming technique for thermal ink jet printers is to subject the printhead nozzles to a vacuum or negative pressure to withdraw ink from the nozzles rather than to subject the printhead to pressure to force the ink from the nozzles.

Accordingly, the maintenance station for a thermal ink jet printhead generally uses a vacuum pump to suck or draw ink from the printhead nozzles.

When priming a printhead, it is useful to apply a sharp vacuum profile to the face of the printhead, as this generally is more effective at removing air bubbles from an attached cartridge. More specifically, by applying a sharp vacuum profile, we can reach a peak vacuum rapidly, which generally is more effective at removing air bubbles. For example, previous vacuum priming systems have had a priming profile that reaches the peak vacuum in less than 0.1 seconds. Currently, a sharp vacuum profile is achieved by building a vacuum reservoir by means of an accumulator chamber and then rapidly applying the vacuum to the printhead by means of a pinch valve.

The following disclosures are mentioned:

U.S. Pat. No. 6,190,007

Patentee: Taylor et al.

Issue Date: Feb. 20, 2001

U.S. Pat. No. 6,174,052

Patentee: Eremity et al.

Issue Date: Jan. 16, 2001

U.S. Pat. No. 6,070,961

Patentee: Premnath et al.

Issue Date: Jun. 6, 2000

U.S. Pat. No. 5,555,461

Patentee: Ackerman

Issue Date: Sep. 10, 1996

U.S. Pat. No. 5,432,538

Patentee: Carlotta

Issue Date: Jul. 11, 1995

U.S. Pat. No. 5,121,130

Patentee: Hempel et al.

Issue Date: Jun. 9, 1992

U.S. Pat. No. 6,190,007 discloses a printhead carriage for an ink jet printer having a plurality of printhead stalls therein. An arcuately moveable air pump is engageable with one of a number of arcuately positioned inlets to the passageways in the carriage cover to enable a single pump to selectively apply positive pressure to prime each of the printheads in a desired sequence.

U.S. Pat. No. 6,174,052 discloses a priming system for ink jet printers, including an ink tank, an ink supply line, an ink bypass line and a valving arrangement that alternately permits either pressurized ink to be supplied to a remote printhead for printing purposes or unpressurized ink to be drawn to the printhead by use of a vacuum source applied to the bypass line. The printer nozzle valve is fitted with an ink bypass line to a source of vacuum. When it is desired to purge and/or prime the ink supply line and nozzle, the air pressure to, or the pump from, the ink supply tank is turned off and vacuum is applied to the bypass line. This sucks ink or solvent from the ink supply tank through the ink line into the nozzle valve and back to a reservoir for reuse or, alternatively, to an ink trap.

U.S. Pat. No. 6,070,961 discloses a priming station for an ink jet printer that includes an ink accumulator tank. In embodiments, the ink accumulator tank is connected between a printhead nozzle face capping member and a vacuum pump.

U.S. Pat. No. 5,555,461 discloses a vacuum pump operated by a drive means. The vacuum pump is connected to a cap by a flexible hose. To prime a printhead, a carriage, upon which a cartridge is removably mounted, is moved from a capped position towards a fixed support member until a pinch valve contacts the support member, causing the pinch valve to rotate against the flexible hose and pinch it closed. When the carriage is returned to the location where the nozzle face is capped, but the flexible hose is no longer pinched closed, i.e., in the capped position, the sealed cap internal recess is subjected to a negative pressure. The print cartridge remains at this position for about one second. The negative pressure begins to drop slightly due to the flow of ink. After about one second, the carriage then moves, breaking the cap seal and stopping the priming. The cap pressure drops and returns to ambient.

U.S. Pat. No. 5,432,538 discloses a valve for use in a maintenance station for an ink jet printer. The maintenance station has a carriage on which a cap that selectively seals the printhead nozzle is mounted. The carriage is movable in and relative to a fixed support member of the maintenance station. A flexible hose interconnects the cap with a pneumatic source for the removal of air and ink from the cap. The selective movement of the carriage towards and away from a wall of the support member pinches the flexible hose closed between them without requiring closely toleranced movement of the carriage.

U.S. Pat. No. 5,121,130 discloses a printhead assembly for a thermal ink jet printer having a plurality of printheads and ink supply paths carrying ink to the printheads. The ink in each supply path then passes to its respective printhead via a tank, the position of which relative to the printhead establishes the ink pressure at the printhead discharge orifices. The tank is vented so that any air separating out from the ink can be removed. Capping means is provided to cap the ink discharge orifices when the printhead is idle and to prime/clean the printhead when required.

The disclosures of all of the above references are hereby incorporated by reference in their entirety.

SUMMARY OF THE INVENTION

Embodiments of the present invention include a method for priming an ink jet printhead that includes first bringing a vacuum pump up to a minimum predetermined speed. The pump is fluidly connected to a capping mechanism or cap through a tube. The minimum predetermined speed of the pump depends upon the size of the pump and the diameter and length of the tube running to the cap. After the pump reaches the minimum predetermined speed, the cap is then sealingly engaged with the printhead. The cap is connected to the printhead for a period of time long enough to prime the printhead (approximately one to three seconds), and then the cap is disengaged from the printhead.

Embodiments of the present invention also include an apparatus for priming a printhead, including a printhead, a capping mechanism sealingly connected to the printhead so as to create an air tight seal around the printhead, a tube in direct fluid communication with the capping mechanism, the tube and the capping mechanism having a combined volume of, for example, from about 355 $mm^3$ to about 455 $mm^3$, and a vacuum pump in direct fluid communication with the tube.

BRIEF DESCRIPTION OF THE DRAWINGS

Aspects of the present invention will become apparent from the following description and upon reference to the Figures, which represent embodiments thereof

DETAILED DESCRIPTION OF EMBODIMENTS

Figure 1:
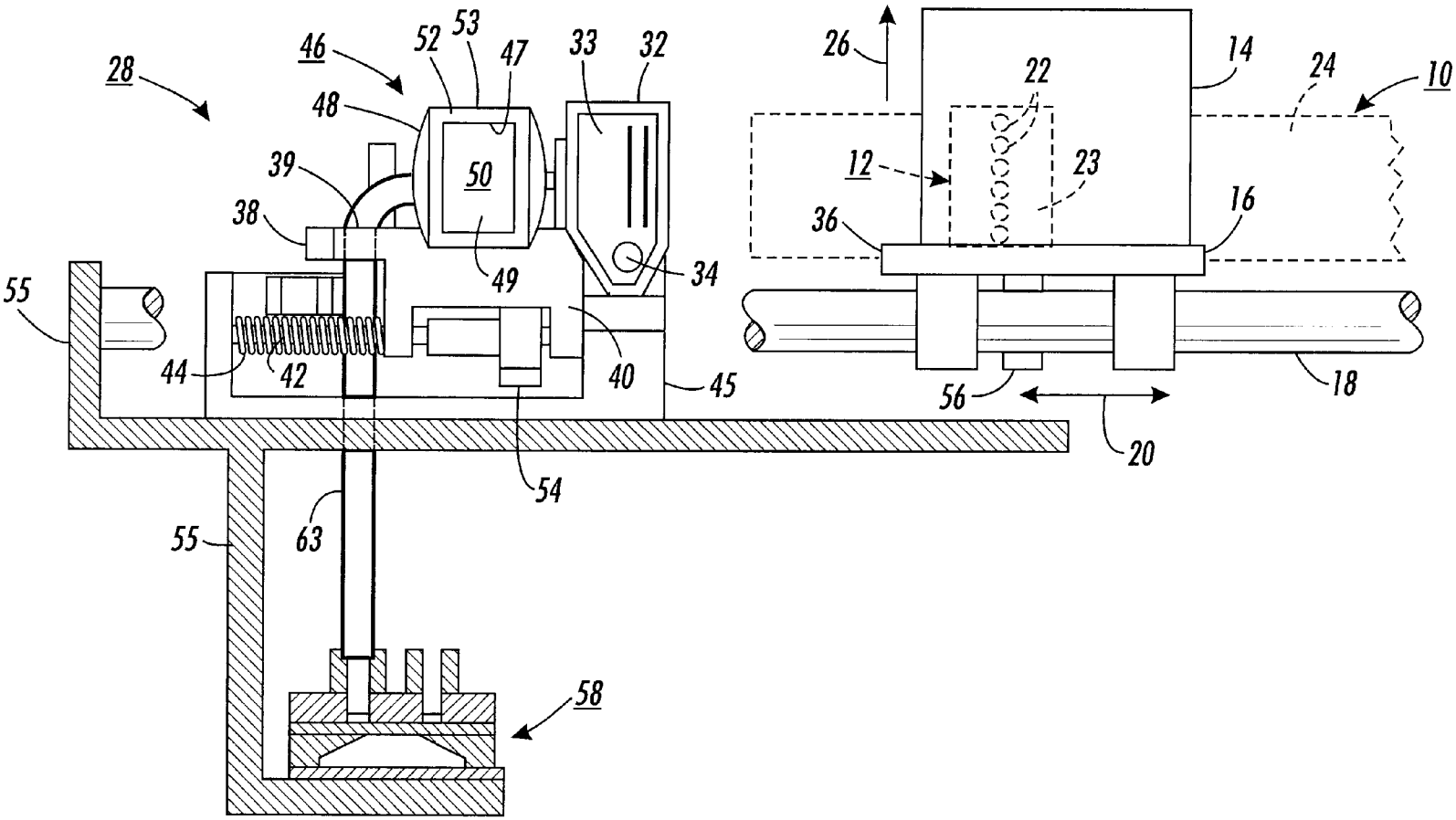
FIG. 1 is a schematic front elevation view of a partially shown ink jet printer having a maintenance station including a vacuum pump.

FIG. 1 illustrates a printer 10 having a printhead 12, shown in a dashed line, which is fixed to an ink supply cartridge 14. The ink supply cartridge 14 can contain black ink or ink that is a color other than black. Examples of colored inks include red, cyan, magenta, yellow, blue, brown, orange, violet, and the like. The cartridge 14 is removably mounted on carriage 16, and selectively translates back and forth on guide rails 18 as indicated by arrow 20, so that the printhead and cartridge move concurrently with the carriage. Printhead 12 includes a plurality of ink channels (not shown) that terminate in nozzles 22 in nozzle face 23 (both shown in dashed line) and carry ink from the cartridge to respective ink ejecting nozzles 22. The method and apparatus disclosed herein can be used with any kind of ink jet printer where the printhead needs to be primed, and the printer details described herein are not to be considered limiting in any manner.

When the printer is in the printing mode, the carriage translates or reciprocates back and forth across and parallel to a printing zone 24 (shown in dashed line). Ink droplets (not shown) are selectively ejected on demand from the printhead nozzles 22 onto a recording medium (not shown), such as paper, in the printing zone to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. No. 4,571,599 and U.S Pat. No. Re. 32,572, the disclosures of which are totally incorporated herein by reference.

At one side of the printer, outside the printing zone, is a maintenance station 28, which includes collection container 32. The carriage will position the print cartridge at this collection container 32, sometimes referred to as a spit station or spittoon, after the print cartridge has been away from the maintenance station for a specific length of time, even if continually printing. The carriage will do this because not all of the nozzles 22 will have ejected enough ink droplets to prevent the ink or meniscus in the little used nozzles from drying and becoming too viscous. Accordingly, the print cartridge will be moved by, for example, a carriage motor (not shown) under the control of the printer controller (not shown). Once the cartridge confronts the spittoon 32, the printer controller causes the printhead to eject a number of ink droplets therein.

After the carriage 16 continues along guide rails 18 beyond the spittoon 32 for a predetermined distance, the carriage actuator edge 36 reaches a priming area. At the priming area the printhead is capped and a negative pressure is applied to the face of the printhead to prime the printhead.

In embodiments such as that shown in FIG. 1, the carriage actuator edge 36 contacts the catch 38 on arm 39 of the cap carriage 40. Cap carriage 40 has a capping mechanism, in this case cap 46, and is reciprocally mounted on guide rail 42 for translation in a direction parallel with the carriage 16 and print cartridge mounted thereon. The cap carriage is biased towards the collection container by spring 44, which surrounds guide rail 42. The cap can be adapted for movement from a location spaced from a plane including the printhead nozzle face 23 to a location wherein the cap seal intercepts the plane containing the printhead nozzle face in response to movement by the cap carriage.

Also, in embodiments, the cap 46 has a closed wall 47 extending from a bottom portion 48 of the cap to provide an internal recess 49, which can have a piece of absorbent material 50 therein. The top edge 52 of the wall 47 and preferably the outside surfaces of the wall 47 including the top edge are covered by a resilient rubber like material 53 that is compliant enough to form a seal, which is relatively air tight and prevents or minimizes air transfer from inside the cap and tube to the atmosphere or vice versa. The resilient material 53, in embodiments, is molded onto the outside walls of wall 47. Once the printhead nozzle face 23 is capped and the cap 46 is locked to the print cartridge, the printer controller may optionally cause the printhead to eject a predetermined number of ink droplets into the cap recess 49 and absorbent material 50 therein for the purpose of increasing humidity in the sealed space of the cap recess.

Figure 2:
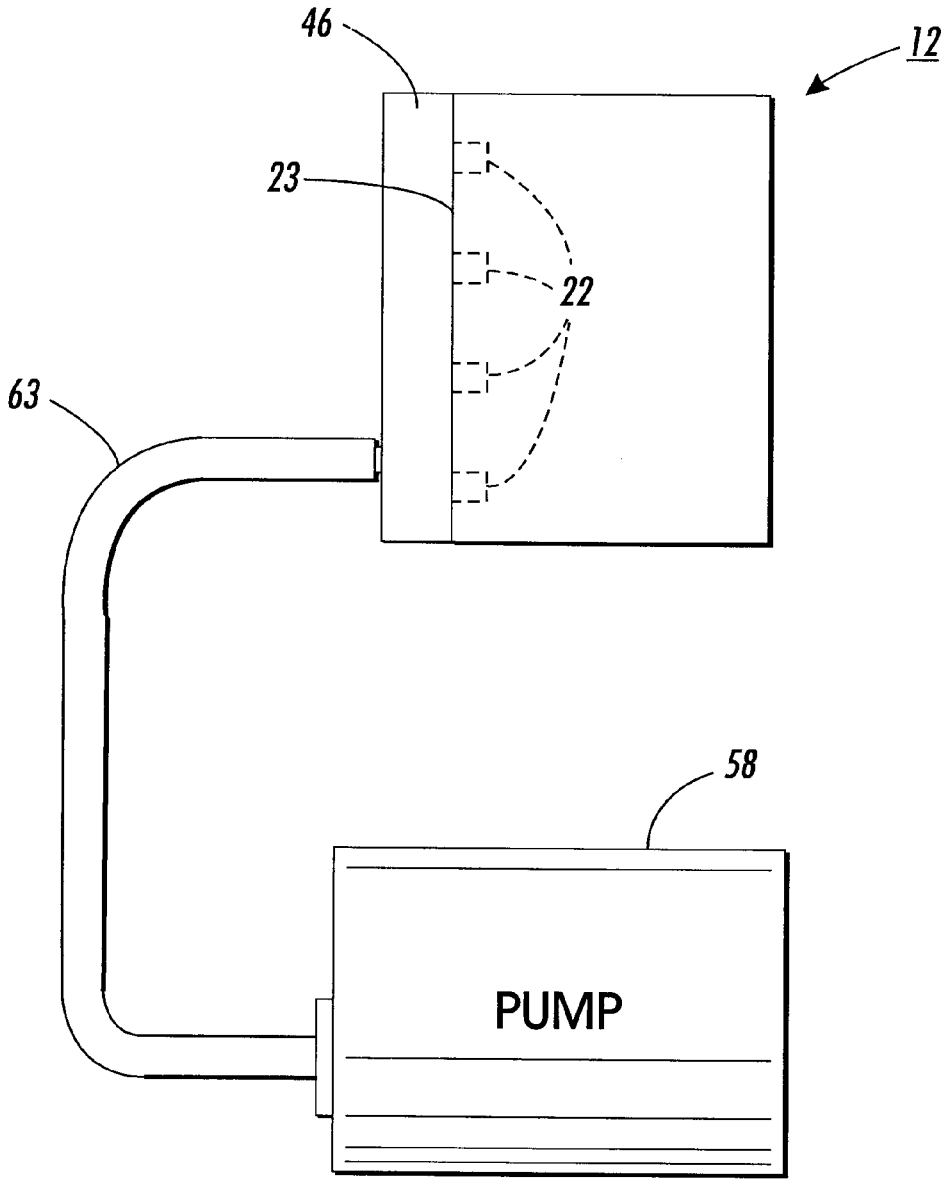
FIG. 2 is a schematic view of a vacuum pump connected to a printhead.

The cap, in embodiments, is connected to a vacuum pump 58. An example of this can be seen more clearly in FIG. 2. A typical vacuum pump 58 can be operated by any known drive means, but in embodiments, the vacuum pump is operated by its own dedicated motor (not shown). The vacuum pump used in present embodiments was peristaltic, but any other kind of vacuum pump, such as a diaphragm pump, may be used as well. The vacuum pump is in direct fluid communication with the cap 46, for example, by a short flexible hose 63. In embodiments, the vacuum pump 58 is mounted to the frame 55. It should be noted that the exact nature of the capping process is irrelevant to the effectiveness of the method disclosed herein. The orientation of the vacuum pump, capping mechanism, and printhead shown in FIGS. 1 and 2 is not required for the priming method disclosed herein to work. For example, the printhead face may be facing in another direction or downward as shown in FIG. 3.

After the carriage actuator edge 36 contacts the catch 38, the print cartridge carriage 16 and cap carriage 40 move in unison to a location where the cap 46 is sealed against the printhead nozzle face 23. At this location, the cap closed wall 47 surrounds the printhead nozzles 22 and the cap seal tightly seals the cap recess 49 around the nozzles.

Figure 3:
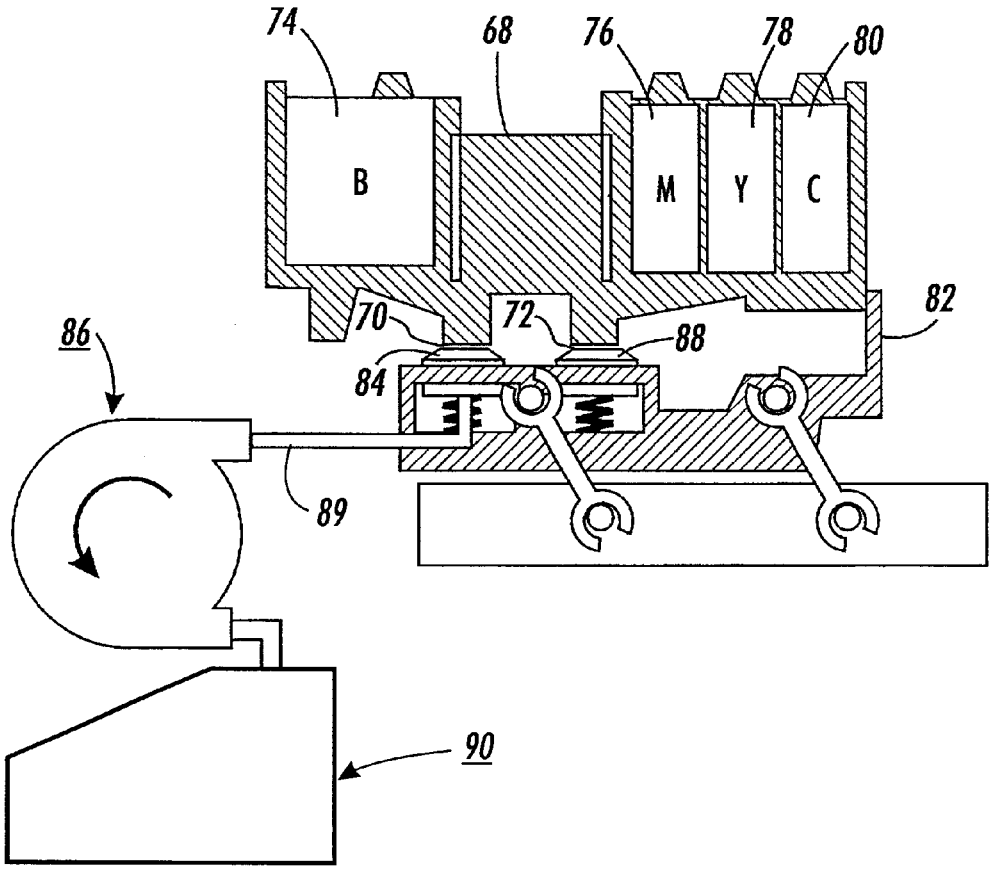
FIG. 3 is a schematic view of another embodiment of a vacuum pump in position to prime a printhead.

FIG. 3 illustrates an embodiment of a print cartridge used in conjunction with the method disclosed herein. As is known in the art, a number of color printers have a cartridge 68 that is connected to at least two separate printheads 70 and 72. The cartridge 68 will often be divided into four containers: a chamber 74 for holding a reservoir of black ink; a chamber 76 for storing magenta ink; a chamber 78 for storing yellow ink; a chamber 80 for storing cyan ink. The chamber 74 containing black ink is fluidly connected with the first printhead 70. The three chambers (76, 78, 80) containing color inks are connected to the second printhead 72. In this configuration, the capping process is similar to the process outlined above, but is accomplished a little differently. In this case, the cartridge moves into a priming station separate from the maintenance station where the spittoon is located. When the print cartridge moves into position to be primed, the vacuum pump 86 is activated. The print cartridge contacts a backstop 82 of the priming station, causing a capping mechanism 84 to move upward into position and contact the printhead 70. After the printhead 70 is primed the capping mechanism 84 is disengaged and the cartridge 68 exits the priming station. If the user prints color images, the vacuum pump will be connected to the capping mechanism 88 that engages the color printhead 72. In some situations, each colored ink-containing chamber may be connected to its own individual printhead. Regardless, the priming method disclosed herein can be used to prime any and all printheads having a nozzle face that on its underside.

In embodiments, prior to capping the printhead, the pump motor is brought up to an operating speed of 380 rpm, which takes a relatively short period of time as compared to the method described in the above paragraph. The minimum operating speed for the hand built vacuum pump used with the present invention is a little below 380 rpm. However, the minimum operating speed will vary depending on the size of the pump, the length and diameter of the tubing connecting it to the cap or capping mechanism, and the volume of space in the capping mechanism. There is no maximum operating speed for priming purposes. Of course, any given pump will have a maximum operating speed and at a high enough speed, there may be risk of damage to the printhead, capping mechanism or tubing. The pump used in the embodiments disclosed herein took less than or about one second to bring it up to speed. However this speed will vary depending on the minimum operating speed of the pump, which is dependent upon the size of the pump, the length and diameter of the tubing connecting it to the cap or capping mechanism, and the volume of space in the capping mechanism.

Referring to FIG. 3, because the pump 86 is working at full speed before the cap 84 is connected, the acceleration ramp of the pump has little or no effect on to the priming process. Once the pump 86 is operating at operating speed the cap 84 is sealed to the face of the printhead 70. The pump 86 is then in direct fluid communication with the printhead 70 through the cap 84 and a tube 89. This creates a sudden, large pressure differential between the face of the printhead 70 and the interior of the cartridge 74. This blows excess air, as well as some ink, out of the cartridge, priming the cartridge for use in less than about two seconds. The ink is drawn out of the printhead 70 and through the pump 86 is deposited in a tray with an absorbent pad (not shown) similar to that used collect and absorb deposits from the spittoon.

The present method of priming a printhead improves on prior methods by being quicker than prior methods. In the prior art, a volume of space having low pressure was first created through use of a pinch valve and sometimes an accumulator. Air would be evacuated from a pinched off chamber. After 10 to 12 seconds, a pressure of approximately negative 120 inches of $H_2O$ would be formed within the pinched off chamber. This level of vacuum was considered sufficient to prime a printhead. After the nozzle face of the printhead was capped, the pinch valve would be released and the face of the printhead would be exposed to the sharp negative pressure for about one second.

The method of the present invention does not require that any level of vacuum be created prior to capping the printhead. This significantly decreases the entire priming time. Depending on various factors, the present method can take from 1 to 4 seconds to implement. Because the vacuum pump no longer has to generate a vacuum before capping the printhead, the pump takes little time to achieve minimum operating speed. In experiments, it was decided to wait one second to allow the pump to achieve operating speed. However, it typically takes less than one second. It is estimated that it takes from about 0.1 seconds to 1 second to achieve operating speed. Once a printhead is capped, the pump takes from about 0.8 seconds to about 1.0 second to effectively prime the printhead 70 connected to a black ink reservoir, and from about 1.5 seconds to about 3.0 seconds to prime the printhead 72 connected to a non-black colored ink reservoir. The lower values reflect the time required for bubble removal in a printhead that is all ready filled with ink. The upper values reflect the time required for filling a new printhead with ink. The small volume of tubing located between the pump and the capping mechanism evacuates rapidly. The vacuum pump expels the ink it intakes during the priming procedure into an ink collection container 90. The pump may be left on for a few seconds after the capping mechanism has been disengaged from the printhead in order to clear the capping mechanism, tubing, and pump of excess ink.

In embodiments, an optimal range of volumes between the vacuum pump 86 and the printhead is from approximately 355 $mm^3$ to approximately 455 $mm^3$. This volume includes the volume of the tube 89 as well as the volume of the cap 84. At larger volumes, the pump 86 can spend a significant amount of time emptying the volume of air contained in the tube 89 and cap 84, thus increasing the total priming time. Also the negative pressure applied to the printhead is not as sudden as it needs to be to efficiently eliminate air bubbles from the ink cartridge 68. Smaller volumes also reduce the effectiveness of the pump. As the inside diameter of the tube 89 gets smaller the rate of flow through the tube decreases due to the impedance resulting from the smaller diameter. If the diameter of the tube 89 is too small, the pump 86 cannot effectively prime the printhead 70, because it cannot apply enough force to the printhead nozzle face (not shown). Thus, it is necessary to optimize the volume of the tube 89 vs. the flow rate through the tube 89. While experiments with different volumes showed that combined cap 84 and tube 89 volumes of from about 355 $mm^3$ to about 455 $mm^3$ are acceptable, a particularly efficient volume was determined to be approximately 405 $mm^3$. It should be noted that these volumes are dependent upon the size and operating speed of the pump being used. The volume in the tube and cap and the operating speed of the pump are interdependent.

This method of priming can be applied in any type of printer where inks need to be primed. It is also envisioned that this priming method may be used to prime other fluid ejecting devices. In those cases, the maximum and minimum volumes will be dependent upon other features such as the power of the pump, the size of the cartridge, the size of the face of the printhead, the viscosity of the fluid, and the amount of priming that needs to be done.

While the present invention has been described in connection with embodiments thereof, it will be understood that it is not intended to limit the invention to these embodiments. On the contrary, it is intended to encompass all alternatives, modifications, and equivalents within the spirit and scope of the appended claims.

What is claimed is:

1. A printhead priming apparatus, comprising a printhead;

a capping mechanism sealingly connected to the printhead;

a tube in direct fluid communication with the capping mechanism, the tube and the capping mechanism having a combined volume of from about 355 $mm^3$ to about 455 $mm^3$; and a vacuum pump in direct fluid communication with the tube.

2. The apparatus of claim 1, wherein the combined volume of the tube and the mechanism is from about 380 $mm^3$ and 430 $mm^3$.

3. The apparatus of claim 1, wherein the combined volume of the tube and the capping mechanism is about 405 $mm^3$.

4. The apparatus of claim 1, further comprising an ink collection container in direct fluid communication with an output of the vacuum pump.

5. The apparatus of claim 1, where the capping mechanism includes an absorbent material located within an internal recess of the mechanism.

6. A printhead priming method, comprising:

bringing a vacuum pump up to a predetermined speed;

sealingly engaging a printhead with a capping mechanism connected to the pump after the pump reaches said predetermined speed, the capping mechanism being connected to the printhead for a period of time less than about two seconds; and disengaging the capping mechanism from the printhead.

7. The method of claim 6, where bringing the vacuum pump up to a predetermined speed takes from about 0.1 second to about 1 second to accomplish.

8. The method of claim 6, where bringing the vacuum pump up to a predetermined speed takes from about 1.5 seconds to about 3 seconds to accomplish.

9. The method of claim 6, where disengaging the capping mechanism is performed from about 0.8 second to about 1 second after engaging the printhead.

10. The method of claim 6, further comprising connecting the capping mechanism to the pump through a tube.

11. The method of claim 10, further comprising sizing the tube to have a volume of from about 355 $mm^3$ to 455 $mm^3$.

12. The method of claim 11, further comprising sizing the tube to have a volume of from about 380 $mm^3$ to 430 $mm^3$.

13. The method of claim 12, further comprising sizing the tube to have a volume of about 405 $mm^3$.

14. The method of claim 6, further comprising causing the printhead to eject a predetermined number of ink droplets into a recess of the capping mechanism after the mechanism is sealingly engaged to the printhead.

15. The method of claim 6, wherein the vacuum pump continues running for several seconds after the capping mechanism is disengaged.

16. A priming apparatus, comprising:

a priming volume of from about 355 $mm^3$ to 455 $mm^3$;

a tube comprising a portion of the priming volume;

a capping mechanism in direct fluid communication with the tube, the capping mechanism comprising a portion of the priming volume;

a printhead to which the capping mechanism is sealingly connected; and a vacuum pump in direct fluid communication with the tube for selective evacuation of the priming volume.

17. The apparatus of claim 16, wherein the combined volume of the tube and the capping mechanism is about 405 $mm^3$.

18. The apparatus of claim 16, further comprising an ink collection container in direct fluid communication with an output of the vacuum pump.

19. The apparatus of claim 16, where the capping mechanism includes an absorbent material located within an internal recess of the mechanism.

20. An apparatus, comprising a priming volume of from about 355 $mm^3$ to about 455 $mm^3$;

a tube comprising a portion of the priming volume;

a capping mechanism in direct fluid communication with the tube, the capping mechanism comprising a portion of the priming volume;

a fluid container having a fluid ejecting face to which the capping mechanism is sealingly connected; and a vacuum pump in direct fluid communication with the tube for selective evacuation of the priming volume.

* * * * *